US007387099B2

(12) United States Patent
Brachos et al.

(10) Patent No.: US 7,387,099 B2
(45) Date of Patent: Jun. 17, 2008

(54) THERMOPLASTIC COMPOSITE INTAKE MANIFOLD

(75) Inventors: Vasilios Brachos, North Andover, MA (US); Vincent Borbone, Sandown, NH (US); Robert M. Miller, Acton, MA (US)

(73) Assignee: Diaphorm Technologies LLC, Salem, NH (US)

( * ) Notice: Subject to any disclaimer, the term of this patent is extended or adjusted under 35 U.S.C. 154(b) by 37 days.

(21) Appl. No.: 11/382,748

(22) Filed: May 11, 2006

(65) Prior Publication Data

US 2006/0254552 A1 Nov. 16, 2006

Related U.S. Application Data

(60) Provisional application No. 60/679,741, filed on May 11, 2005.

(51) Int. Cl.
*F02M 35/10* (2006.01)

(52) U.S. Cl. ..... 123/184.24; 123/184.61

(58) Field of Classification Search ..... 123/184.24, 123/184.42, 184.47, 184.61
See application file for complete search history.

(56) References Cited

U.S. PATENT DOCUMENTS

| | | | | |
|---|---|---|---|---|
| 2,142,445 | A | | 1/1939 | Helwig |
| 3,546,740 | A | | 12/1970 | Johnson |
| 3,642,415 | A | | 2/1972 | Johnson |
| 4,555,378 | A | | 11/1985 | Martin et al. |
| 4,582,665 | A | | 4/1986 | Jabarin |
| 4,666,544 | A | | 5/1987 | Whiteside et al. |
| 4,770,838 | A | | 9/1988 | Cattanach et al. |
| 4,946,640 | A | | 8/1990 | Nathoo |
| 5,037,599 | A | | 8/1991 | Olson |
| 5,047,198 | A | | 9/1991 | Kim |
| 5,156,795 | A | | 10/1992 | Harvey et al. |
| 5,378,134 | A | | 1/1995 | Blot et al. |
| 5,380,480 | A | | 1/1995 | Okine et al. |
| 5,466,146 | A | | 11/1995 | Fritz et al. |
| 5,575,249 | A | | 11/1996 | Mielke et al. |
| 5,875,758 | A | * | 3/1999 | Fujita ..... 123/184.61 |
| 6,083,339 | A | | 7/2000 | Peters et al. |
| 6,149,844 | A | | 11/2000 | Graham |

(Continued)

FOREIGN PATENT DOCUMENTS

JP 09166056 A * 6/1997

OTHER PUBLICATIONS

Holzel and Michaeli, Optimisation of the surface quality of thermoplastic composites with decoration foils(ab), Macromol Mater Eng, (2000), 91-96, 284/285.

(Continued)

*Primary Examiner*—Noah P. Kamen
(74) *Attorney, Agent, or Firm*—Grossman, Tucker, Perreault & Pfleger PLLC

(57) ABSTRACT

An intake manifold for an internal combustion engine including a manifold base portion and a manifold cover portion. The manifold cover portion and base portion are each formed from a thermoplastic composite material. The base portion includes several runners which may be coupled to respective intake ports of an internal combustion head. The manifold base portion and the manifold cover portion may be selected from a group of differing parts to provide a manifold having desired application or performance characteristics.

13 Claims, 3 Drawing Sheets

U.S. PATENT DOCUMENTS

| | | | | |
|---|---|---|---|---|
| 6,283,078 | B1 * | 9/2001 | Munetoki et al. ..... | 123/184.42 |
| 6,749,418 | B2 | 6/2004 | Muirhead | |
| 6,802,293 | B2 | 10/2004 | Iwata et al. | |
| 7,086,365 | B1 * | 8/2006 | Teeter ..... | 123/184.21 |
| 2003/0146543 | A1 | 8/2003 | Lebrum et al. | |

OTHER PUBLICATIONS

Holzel and Schmachtenberg, In-Mould decoration of thermoplastic composites, Internationale AVK-TV Tagung Baden-Baden, (Sep. 2000), 7 pages.

Lebrun et al., Thermoforming/Stamping of Continuous Fibre Reinforced Thermoplastic Composites, Composites 2001 Convention and Trade Show, Composites Fabricators Association, (Oct. 3-6, 2001), Tampa, FL, 1-6.

Saint-Gobain/Vetrotex, T PP Glass/PP Fabrics, Technical data sheet, Twintex, (Jan. 2001), 2 pages.

International Search Report and Written Opinion dated Aug. 17, 2007 issued in corresponding PCT patent application PCT/US06/18116, 7 pages.

Thermoplastic fibre composites, IKV-Composites, (Jan. 13, 2003), 1-2, http://www.rwth-aachen.de/ikv/Ww/abt.fvk/thermoe.html.

* cited by examiner

THERMOPLASTIC COMPOSITE INTAKE MANIFOLD

CROSS-REFERENCE TO RELATED APPLICATIONS

This application claims the benefit of U.S. provisional patent application Ser. No. 60/679,741, filed May 11, 2005, the entire disclosure of which is incorporated herein by reference.

FIELD

The present disclosure generally relates to thermoplastic composite articles, and the use of thermoplastic composite materials for intake manifolds.

BACKGROUND

Internal combustion engines are commonly provided with a supply of air for the combustion process via an intake system. An intake system may commonly include an air filtration unit and an air distribution means for supplying the various cylinders of the internal combustion engine with an appropriate supply of air. Various additional components may also be included in an intake system. For example, a typical intake system may also include a metering mechanism for controlling the airflow to the combustion cylinders individually or as a group. In some instances a fuel delivery system may also be integrated with and/or provided as part of the intake system. In such systems a carburetor and/or fuel injection system may be provided as part of the intake system. According to other engine configurations, fuel delivery may be provided directly to the combustion cylinders and/or at the very entrance to the combustion cylinders.

BRIEF DESCRIPTION OF THE DRAWINGS

Features and advantages of the present invention are set forth by the description of various embodiments consistent therewith, which description should be considered along with the accompanying drawings, wherein.

DESCRIPTION

Figure 1:
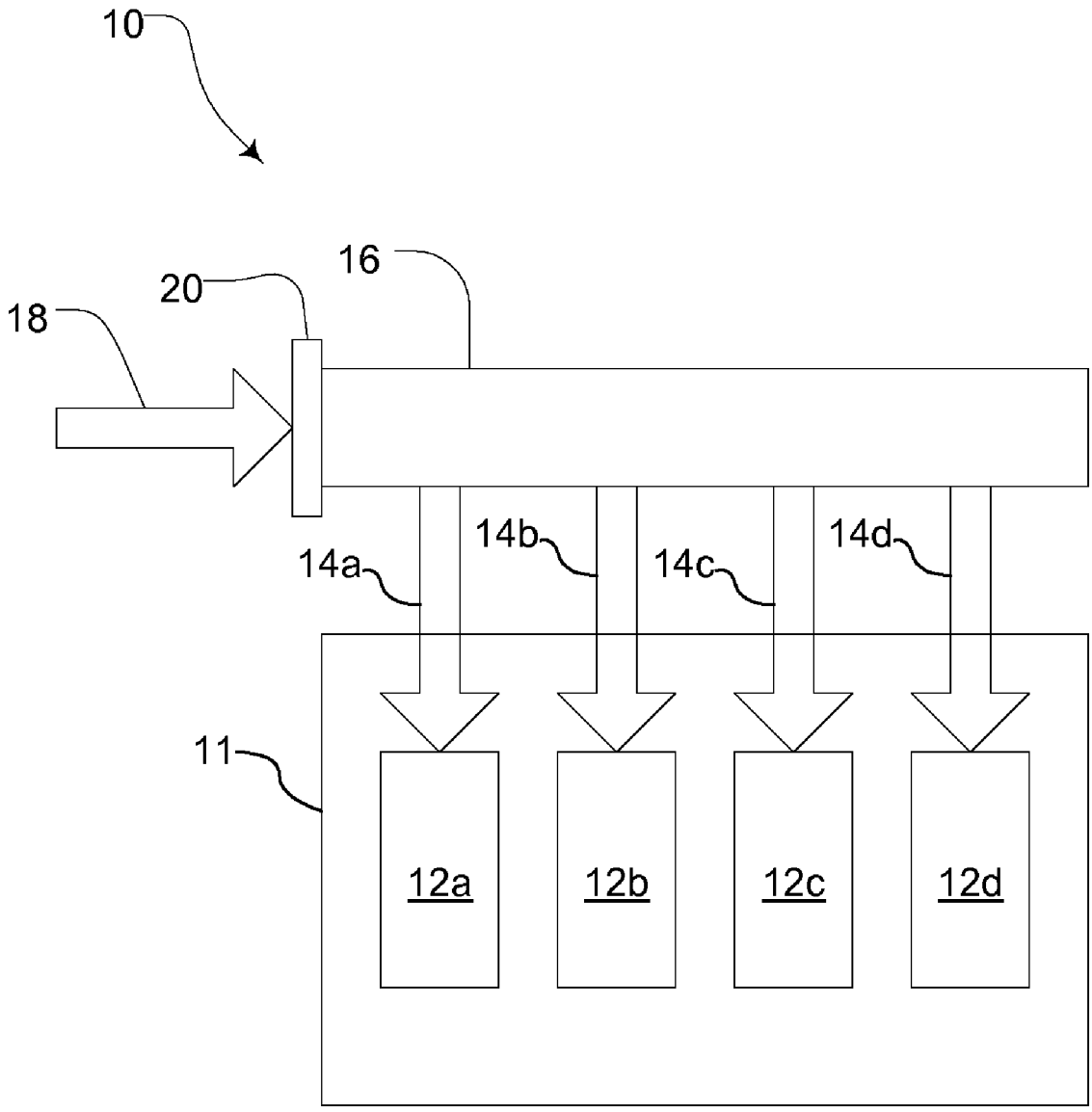
FIG. 1 is a block diagram of an internal combustion system which may include an intake manifold consistent with the present disclosure.

Referring to FIG. 1, a block diagram of an internal combustion system 10 is generally depicted. The system 10 may include an engine 11 including plurality of combustion chambers, e.g., in the form of cylinders 12*a-d*. Each of the cylinders 12*a-d* may be provided with a charge 14*a-d* of air or a mixture of air and fuel. As shown, the charge 14*a-d* of air or air and fuel may be provided from a manifold 16. The manifold 16 may be coupled to a supply of air 18. In the illustrated embodiment, the supply of air may be metered and/or controlled by a throttle 20 or similar device. The manifold 16 may provide a uniform and/or controlled charge 14*a-d* of air or air and fuel to each of the cylinders 12*a-d*. For example, the manifold 16 may provide the charge 14*a-d* of air or air and fuel to each cylinder 12*a-d* having a uniform pressure and/or velocity, etc. Furthermore, in some embodiments the manifold may alter and/or vary the velocity and/or pressure profiles of the charge 14*a-d* of air or air and fuel delivered to each of the individual cylinders 12*a-d*.

Figure 2:
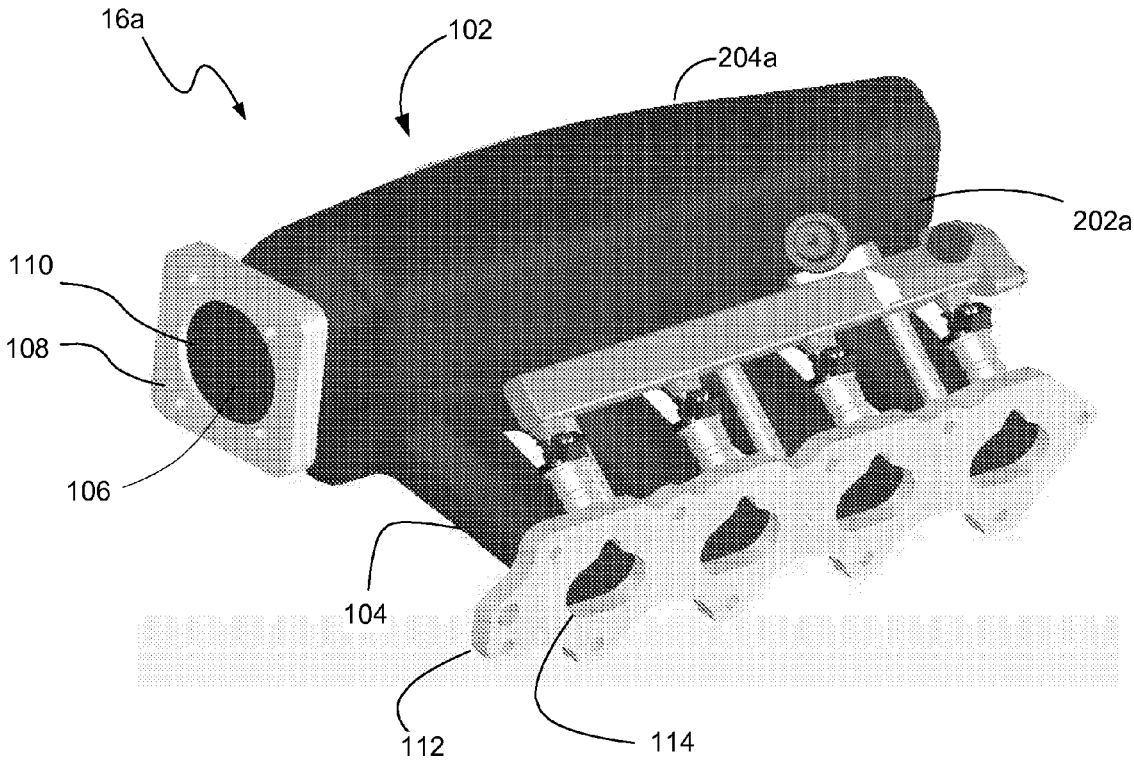
FIG. 2 is a perspective view of an intake manifold consistent with the present disclosure.

Turning to FIG. 2, an embodiment of an intake manifold 16*a* consistent with the present disclosure is illustrated. The illustrated manifold 16*a* may generally include a manifold body 102 and a plurality of runners 104 in fluid communication with the manifold body 102. A manifold inlet 106 may be provided in the manifold body 102. As shown, a mounting flange 108 may be coupled to the manifold 16*a* and may include an opening 110 providing the manifold inlet 106. The mounting flange 108 may be capable of being mounted to a throttle-body, air filter assembly etc., as described previously.

The runners 104 may each provide an outlet from the manifold 16*a*, e.g., for providing one or more cylinder of an internal combustion engine with a charge of air or a charge including a mixture or air and fuel. The length, diameter, and profile of each of the runners 104 may be provided to achieve a velocity and/or pressure profile of the charge of air or air and fuel provided to each of the cylinders of the internal combustion engine. Similar to the manifold inlet 106, the runners 104 may include a mounting flange 112 defining manifold outlets 114 corresponding to each runner 104. The mounting flange 112 may be capable of mounting to a combustion cylinder intake, for example, on a cylinder head of the combustion engine. As depicted, the mounting flange 112 may be provided as a single component coupled to each of the runners and having an opening corresponding to each of the runners. Alternatively, a plurality of separate mounting flanges may be provided, one for each runner.

Consistent with one aspect of the present disclosure, the intake manifold may be formed from a reinforced thermoplastic material, also referred to as a thermoplastic composite material. The thermoplastic composite material may include reinforcing fiber in a thermoplastic matrix. According to various embodiments, a suitable thermoplastic composite material may be provided as sheets of reinforcing fiber and thermoplastic matrix. The sheets may be heated and formed into the desired geometries, and subsequently cooled to generally retain the desired shape and/or geometry.

According to various embodiments, the reinforcing fiber may include carbon fiber, Kevlar fiber, glass fiber, etc. The reinforcing fiber may be provided in a variety of forms. For example, the reinforcing fiber may be provided as a woven cloth, a mat of oriented fibers, a sheet of randomly oriented long fibers and/or randomly oriented short fibers. Various other configurations and/or arrangements may also suitably be employed in connection with the present disclosure. Similarly, a variety of thermoplastic materials may be employed for the matrix of the thermoplastic composite material. According to various embodiments, engineering thermoplastic materials, such as nylon, polycarbonate, etc. may be employed in connection with a thermoplastic composite material herein. Various other thermoplastic materials may also be employed as matrix materials. Various suitable thermoplastic composite sheet products are commercially available in a variety of configurations, including such configurations as a continuous thermoplastic matrix including fiber reinforcements, thermoplastic coated fibers, fibrous sheets impregnated with a thermoplastic material, etc. One suitable thermoplastic composite sheet material is available under the name TPFL from Schappe Techniques may suitably be employed in connection with the present disclosure. Various other materials and configurations may also suitably be employed in connection with the present disclosure.

The use of a thermoplastic composite material may provide light weight intake manifold as compared to conventional metallic intake manifolds and thermoset composite structures. In some embodiments, a thermoplastic composite manifold consistent with the present disclosure may be provided at approximately one quarter of the weight of a conventional metallic manifold. Such weight savings available using thermoplastic composite materials may be achieved while maintaining sufficient product strength. Relatively high strength products, for example as compared to un-reinforced materials, may be achieved consistent with the present disclosure, at least in part, through the use of high strength reinforcing materials. For example, carbon fiber, Kevlar fiber, etc., may provide a high specific strength based on weight of the material.

In addition to the weight savings and strength of the product, a manifold produced using thermoplastic composite may provide performance enhancements for the operation of an associated internal combustion engine, as compared to conventional metallic intake manifolds. According to one aspect, a thermoplastic composite intake manifold may retain and/or may conduct less heat, as compared to a conventional metallic intake manifold. Thermoplastic composite material forming the intake manifold may at least partially thermally insulate a charge of air in and/or flowing through the intake manifold from heat, e.g., heat conducted form the cylinder head, radiated by the exhaust manifold, etc. By thermally insulating the charge of air in and/or flowing through the manifold, the temperature of the charge may be maintained lower compared to a conventional metallic manifold. The lower charge temperature may provide a more dense charge allowing greater power to be generated. Accordingly, power benefits may be realized through the use of a thermoplastic composite intake manifold consistent with the present disclosure.

Figure 3:
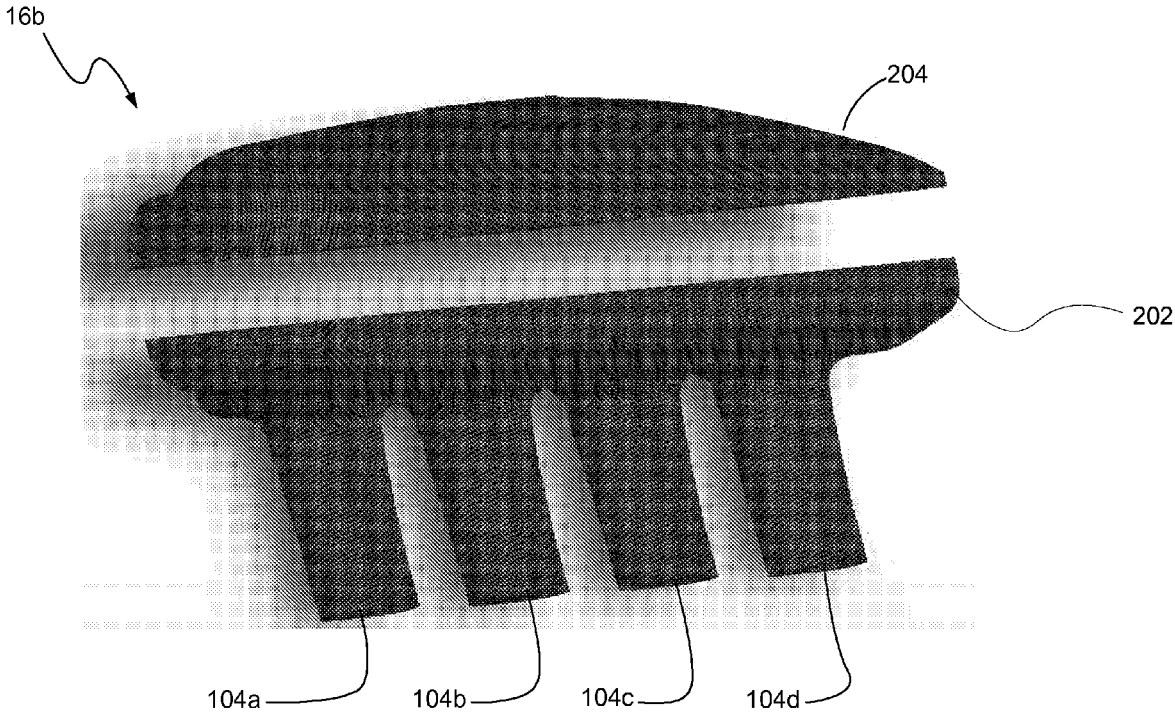
FIG. 3 is an exploded view of a portion of an intake manifold consistent with the present disclosure.

Turning next to FIG. 3, an exploded view of an embodiment of an intake manifold 16*b* is depicted. As shown, the manifold 16*b* may be formed as a separate manifold base 202 and manifold cover 204. As shown, the manifold base 202 may provide a first plenum portion and may include one or more runners 104*a-d* capable of distributing an airflow to individual cylinders of an internal combustion engine. The manifold cover 204 may provide a second plenum portion. The combination of the manifold base 202 and the manifold cover 204 may provide a complete plenum and associated runners 104*a-d* for distributing air from the plenum to individual cylinders of an internal combustion engine.

The manifold base 202 and the manifold cover 204 may each be formed using a variety of suitable processes. For example, in one embodiment the manifold base 202 and/or the manifold cover 204 may be formed via compression molding, in which one or more sheets of thermoplastic composite material may be formed into a desired shape between cooperating mold portions. In another embodiment, the manifold base 202 and/or the manifold cover 204 may be formed using an inflatable bladder technique, in which one or more thermoplastic composite sheets are positioned relative to a mold portion. An inflatable bladder may be positioned relative to the one or more thermoplastic composite sheets and may be inflated to force the one or more thermoplastic composite sheets to conform to the mold portion. Various other forming techniques may also be used for producing a manifold base 202 and/or manifold cover 204 consistent with the present disclosure.

A complete intake manifold may be provided by joining a manifold base 202 and a manifold cover 204. The manifold base 202 and the manifold cover 204 may be joined using any suitable techniques. According to one embodiment, a manifold base 202 may be bonded to a manifold cover 204 using a welding technique, in which the thermoplastic matrix of one, or both, of the manifold base 202 and of the manifold cover 204 may be at least partially softened to provide a bond between the manifold base 202 and the manifold cover 204. Suitable welding techniques may include ultrasonic welding, friction welding, thermal welding, etc. In other embodiments, a manifold base 202 may be joined to a manifold cover 204 by adhesively bonding the manifold base 202 and the manifold cover 204 using a thermoplastic and/or thermoset adhesive. Various other joining techniques, including techniques using mechanical fasteners, may also be employed herein. Furthermore, the manifold base 202 and/or the manifold cover 204 may include features to facilitate joining of the manifold base 202 and the manifold cover 204, such as tongue and groove features, overlapping features, mating flanges, etc.

Consistent with the various suitable forming techniques, the manifold base 202 and/or the manifold cover 204 may be provided having a smooth interior and/or exterior surface geometry. For example, as discussed above, the manifold base 202 and manifold cover 204 may include cooperating features, such as tongue and groove features, overlapping features, off-set overlapping features, etc., which may provide a substantially smooth surface geometry when the manifold base 202 and the manifold cover 204 are jointed. Similarly, a manifold assembled from the manifold base 202 and manifold cover 204 may also exhibit a smooth interior and/or exterior surface, for example exhibiting few or no surface irregularities or roughness. In addition to the smooth character of the surface, the interior geometry of the manifold may provide relatively unimpeded airflow through the manifold and out of the runners. The smooth surface and unimpeded airflow through the manifold may increase the power achievable by a given engine. Therefore, according to one aspect the present disclosure may provide a cost effective manifold design that may exhibit a smooth geometric interior which may improve airflow and/or maximize engine power of an internal combustion engine.

The use of a separate manifold base 202 and manifold cover 204 may allow the performance characteristics of the intake manifold 16*b* to be varied and/or controlled. For example, the manifold base may be provided having a runner configuration adapted for a specific application, i.e., capable of being coupled to a cylinder head of a specific engine. A manifold cover 204 may be provided to achieve a manifold volume, producing resultant performance characteristics of the specific engine. A variety of manifold covers may be provided to achieve different manifold volumes, producing different resultant performance characteristics for the specific engine. Accordingly, for a given manifold base a plurality of manifold covers may be provided for achieving different manifold volumes. The plurality of manifold covers may be selectively coupled to the manifold base to achieve a desired manifold volume and resultant performance characteristics. According to such an aspect, a single manifold base configuration may be used with a plurality of different manifold cover configurations to achieve varying manifold characteristics.

Similarly, for a given manifold cover 204 a plurality of different manifold bases 202 may be provided. According to one aspect, the plurality of manifold bases 204 may include runners 104*a-d* adapted for use with different specific engines. For example, the number, end geometry, spacing, etc., of the runners may be varied for use with specific engines, such as an inline 4-cylinder engine, a V-6 engine, etc., and/or specific models of such engine configurations. A manifold cover configuration providing a given manifold volume may be used in conjunction with a variety of different specific engines by coupling the manifold cover to a manifold base selected to be coupled to a specific engine. According to this aspect, a single manifold cover configuration may be used with a plurality of different manifold base configurations to allow the use of the manifold with a variety of different specific engines.

In a related embodiment, a plurality of manifold base configurations may be provided for application with a given specific engine to achieve different performance characteristics. For example, the length and/or diameter of the runners 104*a-d* may be provided to achieve a velocity and/or pressure profile, etc., of air flowing through the runners 104*a-d* to the engine. The velocity and/or pressure profile, etc., of air flowing through the runners 104*a-d* to the engine may provide resultant performance characteristics of the engine. Therefore, a plurality of manifold base configurations may be provided having different runner configurations, which may be used in connection with a common manifold cover configuration to provide a variety of different performance characteristics for a given specific engine.

Consistent with the foregoing, a manifold may be provided by selecting and combining one of plurality of manifold cover configurations, which may each provide a different manifold volume, and one of a variety of manifold base configurations, each of which may provide a different runner configuration suitable for a specific engine application and/or performance characteristic. The resultant manifold may provide performance characteristics based on the selected manifold cover configuration and the selected manifold base configuration for a given specific engine. Accordingly, a manifold consistent with the present disclosure may provide flexibility both in terms of resultant performance characteristics as well as in terms of application, i.e., specific engines.

With reference back to the embodiment of an assembled manifold 16*a* is shown in FIG. 2, as mentioned the assembled manifold 16*a* may generally include a lower manifold base portion 202*a* including the plurality of runners, e.g., 104. As indicated by FIG. 3, the assembled manifold 16*a* may further include an upper manifold cover portion 204*a* coupled to the manifold base portion 202*a*. As previously mentioned, the manifold 16*a* may further include an inlet mounting flange 108 and/or may include one or more runner mounting flanges 112. The inlet mounting flange 108 may be mechanically and/or adhesively coupled to the manifold base portion 202*a* and/or the manifold cover 204*a*. For example, as shown, at least a portion of the manifold base portion 202*a* and/or the manifold cover 204*a* may be at least partially disposed in the opening 110 of the inlet flange 108. The portion of the manifold base 202 and/or the manifold cover 204*a* disposed within the opening 110 of the inlet flange 108 may be bonded and/or otherwise affixed to the inlet flange 108. In a similar manner, the runner mounting flange 112 may be coupled to the runner mounting flange 112, as by being mechanically, adhesively, etc. affixed to the runner mounting flange 112. For example, in an embodiment consistent with the present disclosure, at least a portion of a runner 104 may be at least partially received in the manifold outlet 114 disposed in the runner mounting flange 112. The portion of the runner 104 at least partially received in the manifold outlet 114 may be bonded to the runner mounting flange 112.

The inlet mounting flange 108 and the runner mounting flange 112 may be formed from a metallic material, such as cast and/or machined aluminum, steel, etc. Various other metallic materials, ceramics, thermoset and/or thermoplastic composites, and/or combinations thereof may also suitably be employed for producing the inlet mounting flange 108 and/or the runner mounting flange 112. Providing the inlet mounting flange 108 and/or the runner mounting flange 112 as a separate component coupled to the manifold base 202*a* and/or the manifold cover 204*a* may allow the use of a mounting arrangement having greater tolerances and/or complexity than may be efficiently available through integrally molding mounting features on the manifold base 202*a* and/or the manifold cover 204*a*.

According to one aspect of the present disclosure, an intake manifold is provided that may include a thermoplastic composite base portion having a plurality of runners extending from the base portion. The intake manifold may further include a thermoplastic composite cover portion coupled to the base portion. The intake manifold may further include a metallic mounting flange coupled to at least on of the plurality of runners and a metallic inlet flange coupled to at least one of the base portion and the cover portion.

According to another aspect of the disclosure, a method is provided for producing a selectively tuned intake manifold. The method may include providing a manifold base portion having a plurality of runner extending from the base portion. The runners may be adapted to provide an intake stream to each of a plurality of combustion cylinders. The method may also include providing a plurality of manifold cover portions, each defining a different volume. The method may further include assembling the manifold base portion an one of the plurality of manifold cover portions to provide a performance characteristic.

According to yet another aspect of the disclosure, there may be provided a method of producing an intake manifold. The method may include providing a manifold cover portion and a plurality of manifold base portions. Each of the manifold base portions may include a plurality of runners. The plurality of runners of each base portion may have a different configuration as compared to the other base portions. The method may further include assembling the manifold cover portion with one of the plurality of manifold base portions to provide one of a desired application characteristic or a desired performance characteristic.

The preceding description has detailed various particular embodiments consistent with the present invention. It will be appreciated by those having skill in the art that the various features and aspects of the several embodiments are susceptible combination with one another, as well as to modification. Accordingly, the scope of the present invention should not be construed as being limited to the particular disclosed embodiments.

What is claimed is:

1. An intake manifold comprising:

a thermoplastic composite base portion comprising a plurality of runners extending from said base portion, said thermoplastic composite base portion comprising a first portion defining at least a portion of an inlet opening of a manifold inlet;

a thermoplastic composite cover portion coupled to said base portion, said thermoplastic composite cover portion comprising a second portion defining at least a portion of said inlet opening of said manifold inlet;

a metallic mounting flange coupled to at least one of said plurality of runners; and a metallic inlet flange coupled to said inlet opening of said manifold inlet, wherein said base portion and said cover portion are welded together to form said inlet opening of said manifold inlet and to provide a substantially smooth interior and exterior surface.

2. An intake manifold according to claim 1, wherein said mounting flange comprises a plurality of openings, and at least a portion of a respective one of said plurality of runners is received in each opening.

3. An intake manifold according to claim 2, wherein said mounting flange is adapted to be coupled to a cylinder head of an internal combustion engine for providing an airflow from an interior of said manifold.

4. An intake manifold according to claim 3 wherein said inlet flange comprises an opening adapted to receive at least a portion of said base portion and at least a portion of said cover portion.

5. An intake manifold according to claim 4, wherein said inlet flange is adapted to be coupled to a throttle body for controlling an airflow into said manifold.

6. A method of producing a selectively tuned intake manifold, said method comprising:

providing a thermoplastic composite manifold base portion comprising a plurality of runners extending from said base portion, said runners adapted to provide an intake stream to each of a plurality of combustion cylinders, said thermoplastic composite manifold base portion comprising a first portion defining at least a portion of an inlet opening of a manifold inlet, providing a plurality of thermoplastic composite manifold cover portions defining a different volume, wherein at least one of said plurality of thermoplastic composite manifold cover portions comprises a second portion defining at least a portion of said inlet opening of said manifold inlet; and welding together said thermoplastic composite manifold base portion and one of said plurality of thermoplastic composite manifold cover portions to form said inlet opening of said manifold inlet and to provide a performance characteristic.

7. A method according to claim 6, wherein said performance characteristic comprises a manifold internal volume.

8. A method of producing an intake manifold comprising:

providing a thermoplastic composite manifold cover portion, said thermoplastic composite manifold base portion comprising a first portion defining at least a portion of an inlet opening of a manifold inlet;

providing a plurality of thermoplastic composite manifold base portions each comprising a plurality of runners, said runners of said respective manifold base portions having a different configuration, wherein at least one of said plurality of thermoplastic composite manifold cover portions comprises a second portion defining at least a portion of said inlet opening of said manifold inlet; and welding together said thermoplastic composite manifold cover portion with one of said plurality of thermoplastic composite manifold base portions to form said inlet opening of said manifold inlet and to provide one of a desired application characteristic or a desired performance characteristic.

9. A method according to claim 8, wherein said runners of said respective manifold base portions comprise different length to diameter ratios.

10. A method according to claim 8, wherein said respective manifold base portion comprises a different number of runners.

11. A method according to claim 8, wherein said runners of said respective manifold base portions comprises a different layout.

12. A method according to claim 8, further comprising coupling said runners of said one of said plurality of manifold base portions to a metallic mounting flange.

13. A method according to claim 8, further comprising coupling a metallic inlet flange to said assembled manifold cover portion and said manifold base portion.

* * * * *